US006547237B2

(12) United States Patent
Sugino et al.

(10) Patent No.: US 6,547,237 B2
(45) Date of Patent: Apr. 15, 2003

(54) SHEET FEEDER

(75) Inventors: Akira Sugino, Nagano (JP); Kazuhiro Hashii, Nagano (JP); Toyoto Inoue, Nagano (JP); Katsura Miyazawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 7 days.

(21) Appl. No.: 09/899,529

(22) Filed: Jul. 6, 2001

(65) Prior Publication Data

US 2002/0014734 A1 Feb. 7, 2002

(30) Foreign Application Priority Data

Jul. 6, 2000 (JP) ..... 2000-205220

(51) Int. Cl.[7] ..... B65H 3/06; B65H 1/08

(52) U.S. Cl. ..... 271/119; 271/121; 271/127

(58) Field of Search ..... 271/119, 120, 271/121, 127, 167

(56) References Cited

U.S. PATENT DOCUMENTS 5,996,989 A * 12/1999 Cahill et al. ..... 271/121
5,997,198 A * 12/1999 Murayama et al. ..... 271/121
6,070,867 A * 6/2000 Tsurumi et al. ..... 271/119

* cited by examiner

*Primary Examiner*—John M. Jillions
(74) *Attorney, Agent, or Firm*—Sughrue Mion, PLLC

(57) ABSTRACT

A sheet feeding roller is brought into contact with an uppermost sheet stacked on a hopper, and rotates to feed the uppermost sheet to the recording apparatus. A separation pad presses the uppermost sheet against the feeding roller so that the upper most sheet is separated from a next uppermost sheet. A first sheet returner pushes back a first part of the next uppermost sheet situated on the separation pad to the hopper. A second sheet returner pushes back a second part of the next uppermost sheet situated on the separation pad to the hopper. The sheet feeding roller, the separation pad and the first sheet returner are incorporated in a single unit which is disposed at a first position of a sheet feeding passage formed on the hopper. The second sheet returner is solely disposed at a second position of the sheet feeding passage.

9 Claims, 5 Drawing Sheets

SHEET FEEDER

BACKGROUND OF THE INVENTION

The present invention relates to a sheet feeder which feeds sheets of paper stacked within a hopper one by one from the uppermost one to an apparatus such as a printer etc.

Some of the printers coupled to the personal computers are provided with sheet feeders. Such a sheet feeder supplies sheets of paper stacked on the hopper one by one from the uppermost one to a transferring roller of the printer by using a sheet feeding roller and a separation pad of a sheet feeding roller unit.

Then, the transfer operation of the transferring roller and the recording operation of a recording head are alternately executed with respect to the sheet thus supplied to the transferring roller of the printer, thereby to record an image including characters on the sheet thus transferred, and the sheet thus recorded is ejected.

A sheet returner and an idle roller are also provided at the sheet feeding roller unit. The sheet feeding roller unit operates after the rear end of the uppermost sheet moves away from a nipping portion between the separation pad and the idle roller to thereby return on the hopper the next-positioned sheet which leading end is located on the separation pad.

However, a plurality of, usually, two sheet feeding roller units each configured in the aforesaid manner are provided in a sheet feeding passage. It is sufficient, according to the present invention, to provide the single sheet feeding roller unit in the sheet-width direction in order to supply the sheet to the printer by using the sheet feeding roller and the separation pad of the sheet feeding roller unit. In view of such a fact, it is not ideal to provide a plurality of sheet feeding roller units in the width direction of the sheet feeding passage, and the provision of the plural sheet feeding roller units results in the increase of the number of the parts.

However, it is necessary to dispose the plural sheet feeding roller units provided with the sheet returners in the width direction of the sheet feeding passage in order to return the sheet which leading end is located on the separation pad on the hopper without being skewed by the sheet returners.

Further, the hopper of the sheet feeder is provided with an edge guide which is slidable in the width direction of the sheet. There is a sheet feeder which is configured in a manner that one of the sheet feeding roller units is coupled to the edge guide and slidable together with the edge guide in the width direction of the sheet. However, according to such a sheet feeder, the resistance (sliding load) caused at the time of sliding the edge guide becomes large and so the operability of the edge guide is degraded.

On the other hand, when the sheet is nipped between the sheet feeding roller in the sheet feeding roller unit and the separation pad, a force from the separation pad toward the sheet feeding roller, that is, a force directed to a back face of a separation pad holder for supporting the separation pad acts. The nipping state between the sheet feeding roller and the separation pad becomes insufficient due to the action of the force in the back face direction, so that there may occur such a phenomenon that the sheets are not supplied well one by one by the sheet feeding roller and the separation pad.

SUMMARY OF THE INVENTION

In view of the aforesaid circumstances, an object of the invention is to provide a sheet feeder which can return a sheet without being skewed, supply well a sheet to a sheet supply target from the hopper and realize the benefits. Further, another object of the invention is to provide a sheet feeder which can secure preferably the pressure contact state between a sheet feeding roller and a separation pad and supply a sheet well to the sheet supply target from the hopper.

In order to achieve the above objects, according to the present invention, there is provided a sheet feeder for feeding sheets of a recording medium to a recording apparatus comprising:

- a hopper, on which the sheets of recording medium are stacked;
- a sheet feeding roller, which is brought into contact with an uppermost sheet stacked on the hopper, and rotates to feed the uppermost sheet to the recording apparatus;
- a separation pad, which presses the uppermost sheet against the feeding roller so that the upper most sheet is separated from a next uppermost sheet;
- a first sheet returner, which pushes back a first part of the next uppermost sheet situated on the separation pad to the hopper; and
- a second sheet returner, which pushes back a second part of the next uppermost sheet situated on the separation pad to the hopper,
- wherein the sheet feeding roller, the separation pad and the first sheet returner are incorporated in a single unit which is disposed at a first position of a sheet feeding passage formed on the hopper, and the second sheet returner is solely disposed at a second position of the sheet feeding passage.

In this configuration, since the required number of parts are decreased, not only the sheet can be returned without being skewed and supplied well to the recording apparatus from the hopper, but also the benefits of the sheet feeder can be realized.

Preferably, the first sheet returner and the second sheet returner are provided immovably in a widthwise direction of the sheet feeding passage.

In this configuration, since none of the first sheet returner or the second sheet returner moves in the widthwise direction of the sheet feeding passage in cooperation with a slidable edge guide of the hopper, the resistance (sliding load) caused at the time of sliding the edge guide can be reduced and so the sliding operation of the edge guide can be performed smoothly.

Preferably, the sheet feeder further comprises guide members which are separately provided in the vicinity of the first sheet returner and the second sheet returner, each of the guide members having a guide face which forms a part of the sheet feeding passage.

In this configuration, as compared with the case where these guide members are formed continuously in the widthwise direction of the sheet feeding passage, even if the next uppermost sheet on the hopper which leading end is positioned at the separation pad is skewed or warped, the sheet is guided by the guide members by the operation of the first and second sheet returners and so the next uppermost sheet can be surely returned to the hopper. Therefore, in accordance with the forward rotation of the sheet feeding roller which is operated next, only the next uppermost sheet on the hopper can be supplied to the recording apparatus, and the sheets can be prevented from being supplied in a duplicated manner.

Preferably, the hopper includes an edge guide member, on which one side edges of the stacked sheets are aligned. Here, the first position of the sheet passage is in the vicinity of the edge guide member. A distance between the edge guide member and the second position almost corresponds to a width of a sheet having a size in a range from A6 to B5.

In this configuration, the sheet having the size equal to or smaller than almost A6 is returned to the hopper only by the first sheet returner, the sheet having the size in a range larger than almost A6 and to almost B5 is returned to the hopper only by the first sheet returner or by both the first and second sheet returners, and the sheet having the size larger than almost B5 is returned to the hopper by both the first and second sheet returners. In this manner, any sizes of the sheet can be surely returned to the hopper by these sheet returners without being skewed.

Preferably, the second sheet returner includes a sheet returning lever, and a lever cam, which is integrally provided with a rotary shaft of the sheet feeding roller, for operating the sheet returning lever.

In this configuration, the accuracy of the parts of the lever cam can be improved and the number of the parts thereof can be reduced.

According to the present invention, there is also provided a sheet feeder for feeding sheets of a recording medium to a recording apparatus, comprising:

- a hopper, on which the sheets of recording medium are stacked;
- a sheet feeding roller, which is brought into contact with an uppermost sheet stacked on the hopper, and rotates to feed the uppermost sheet to the recording apparatus;
- a separation pad, which presses the uppermost sheet against the feeding roller so that the upper most sheet is separated from a next uppermost sheet; and
- a cover member, which covers the sheet feeding roller, and is secured to the recording apparatus such that a force acting from the separation pad to the sheet feeding roller when the uppermost sheet is fed is received by the recording apparatus.

Here, it is preferable that the cover member is formed with a hook member engaged with a part of the recording apparatus so that the force is received by the recording apparatus through the hook member.

In this configuration, the sheet feeding roller is prevented from moving to a direction to which the force is acted when the sheet is fed to the recording apparatus. As a result, the pressure contacting state between the sheet feeding roller and the separation pad is secured well and the sheet can be supplied well to the recording apparatus from the hopper.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

One embodiment of the invention will be explained with reference to the accompanying drawings.

Figure 1:
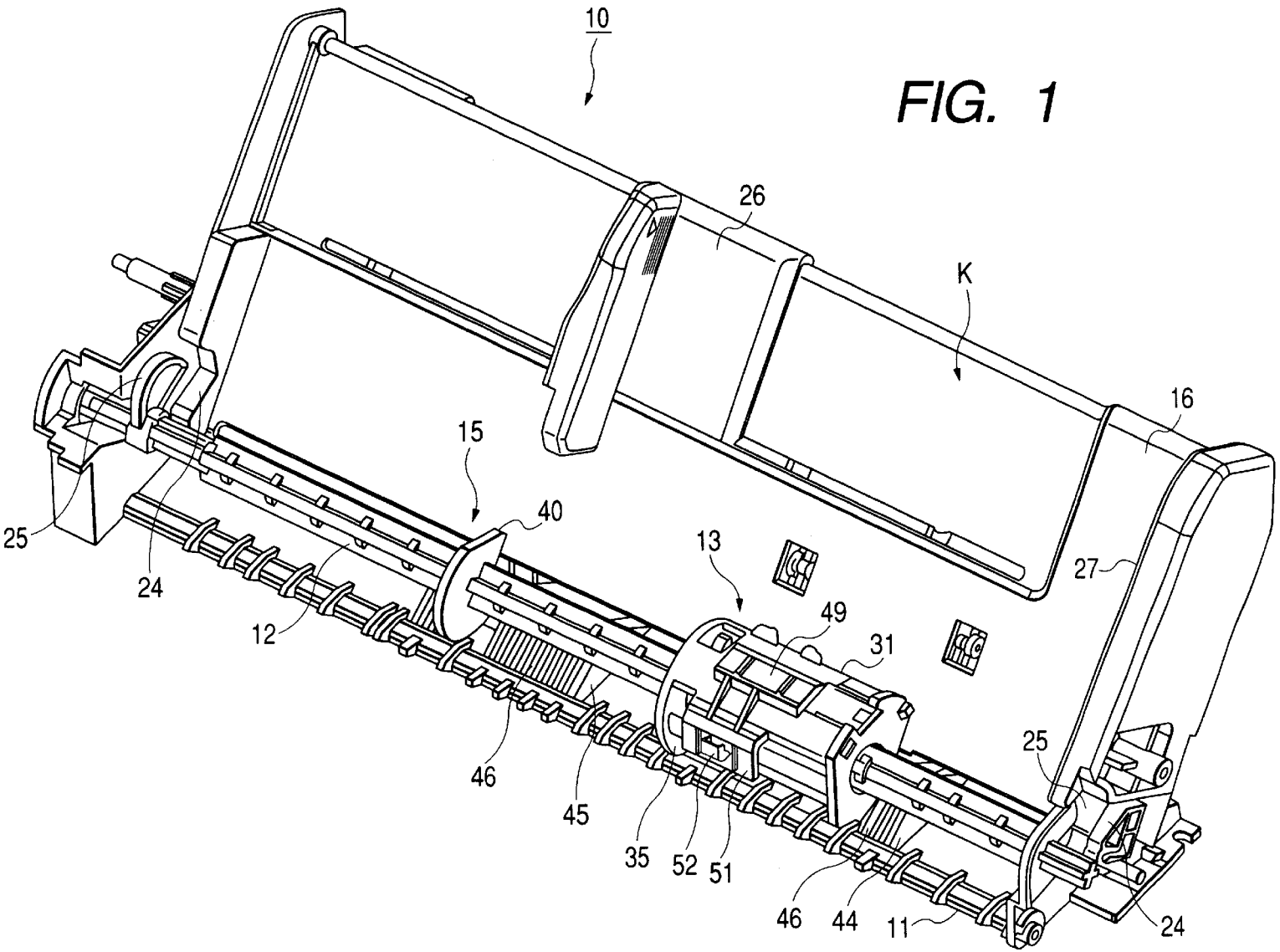
FIG. 1 is an entire perspective view showing a sheet feeder according to one embodiment of the invention.

As shown in FIG. 1, a sheet feeder 10 is configured by an apparatus frame 11, a roller shaft 12 made of resin, for example, rotatably supported by the apparatus frame 11, a sheet feeding roller unit 13 and a second sheet returner 15 provided at the roller shaft 12 as described later, and a hopper 16 rotatably attached to the apparatus frame 11.

Figure 5:
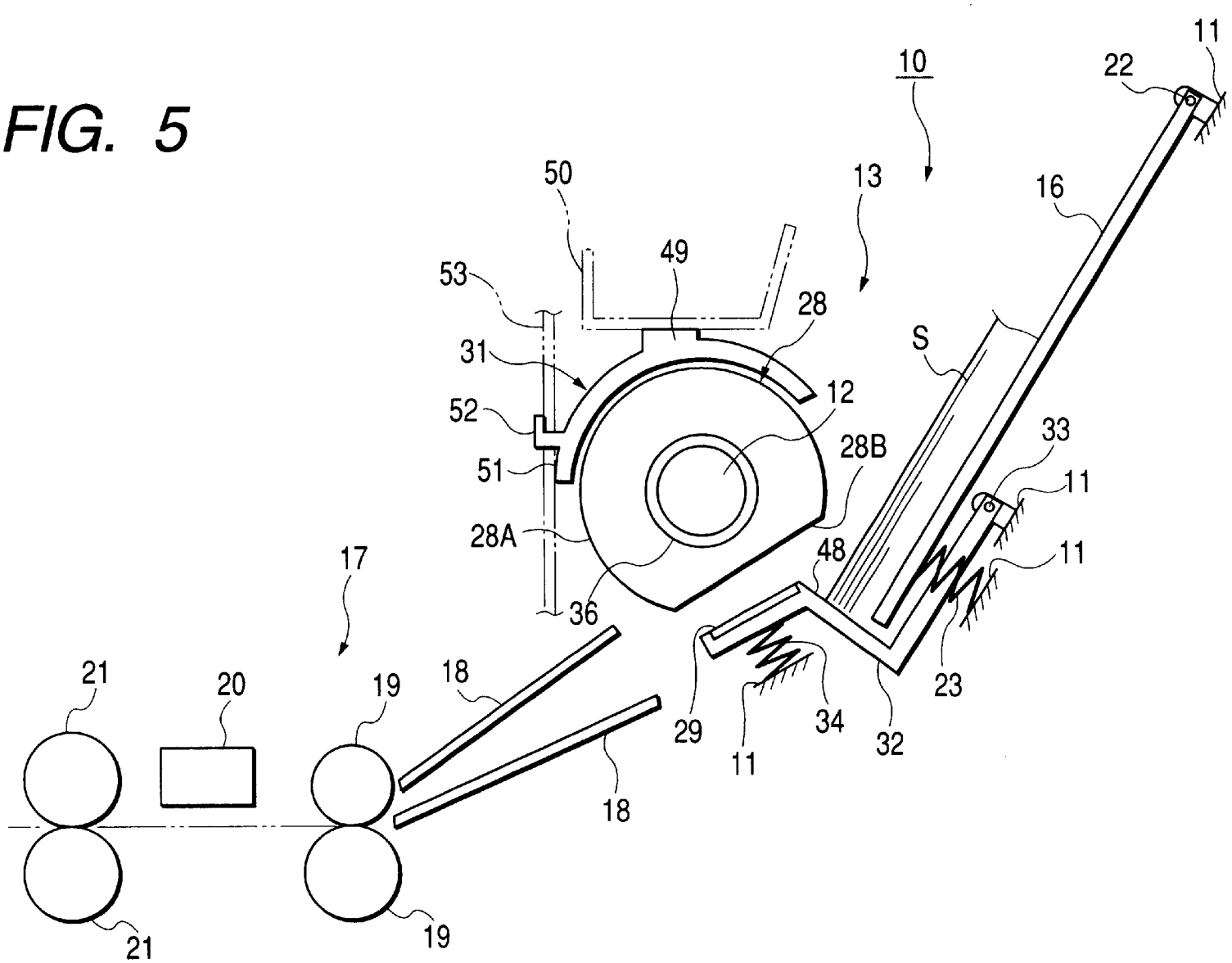
FIG. 5 is a schematic side sectional view showing the sheet feeder of FIG. 1 and a printer incorporating the same.

As shown in FIG. 5, the sheet feeder 10 is assembled in a printer 17 (ink jet printer) to which sheets are supplied. The printer 17 has sheet guides 18, a transferring roller pair 19, a recording head 20 and a discharging roller pair 21. When a sheet S is supplied to the printer 17 from the sheet feeder 10, the sheet S thus supplied passes between the pair of the sheet guides 18 of the printer 17. Then, the transfer operation of the transferring roller pair 19 and the recording operation of the recording head 20 are alternately executed thereby to record an image including characters on the sheet thus transferred, and the sheet thus recorded is ejected out of the printer 17 by the discharging roller pair 21.

In this respect, the sheet S is a cut sheet such as a plain sheet, a coated sheet, an OHP (overhead projector)sheet, a glossy sheet, a glossy film etc.

The hopper 16 of the sheet feeder 10 is pivotally supported by the apparatus frame 11 through a shaft 22 so as to be rotatable and disposed in a skewed manner with respect to the printer 17. A plurality of sheets S are stacked on the hopper 16. In this case, the leading ends of the sheets S thus set abut against a back face 48 of a separation pad holder 32 and a back face 47 of guide members 44, 45 and then are aligned.

As shown in FIG. 5, a hopper spring 23 is disposed between the leading end portion of the hopper 16 and the apparatus frame 11. The hopper 16 serves to make the sheets S be able to contact with the sheet feeding roller 28 (described later) of the sheet feeding roller unit 13 due to the urging force of the hopper spring 23 at the time of the sheet supplying operation of the sheet feeding roller 28. Further, as shown in FIG. 1, cam followers 24 are formed at the both sides of the leading end portion of the hopper 16, respectively. When the cam followers 24 abut against the hopper cams 25 fixed at the both ends of the roller shaft 12, respectively, the rotation of the hopper 16 due to the hopper spring 23 is restricted.

Figure 2:
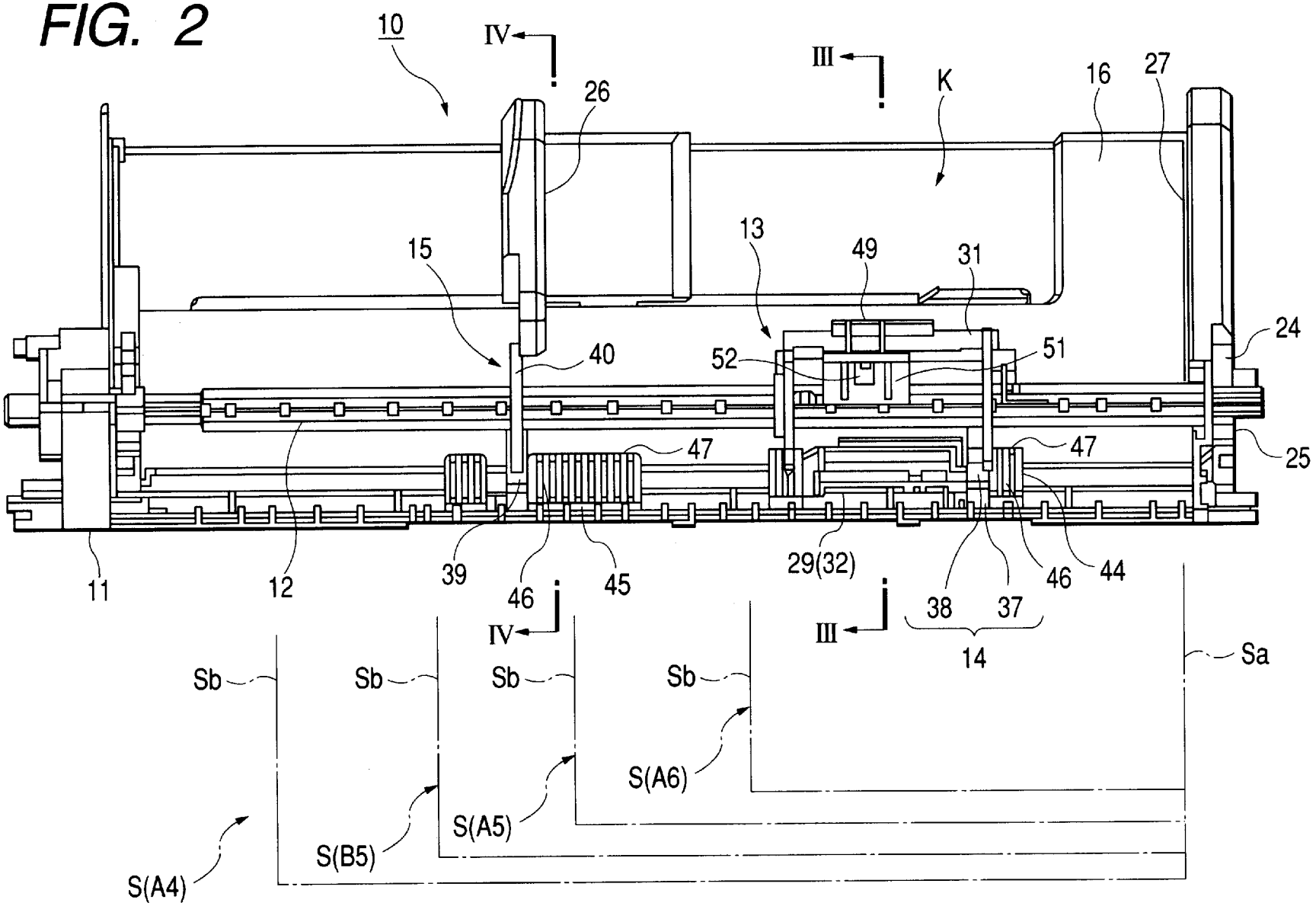
FIG. 2 is a front view of the sheet feeder of FIG. 1.

Further, as shown in FIGS. 1 and 2, the hopper 16 is provided with an edge guide 26 which is slidable in the width direction of the sheet S. The edge guide 26 is operated so as to be slid to match with the width of the sheet S set in the hopper 26. The sheet S to be supplied is positioned so as to abut at its one side edge Sa against a side wall 27 serving as the one end side of the apparatus frame 11 constituting a sheet feeding passage K and also positioned so as to abut at it's the other end side Sb against the edge guide 26.

Figure 3:
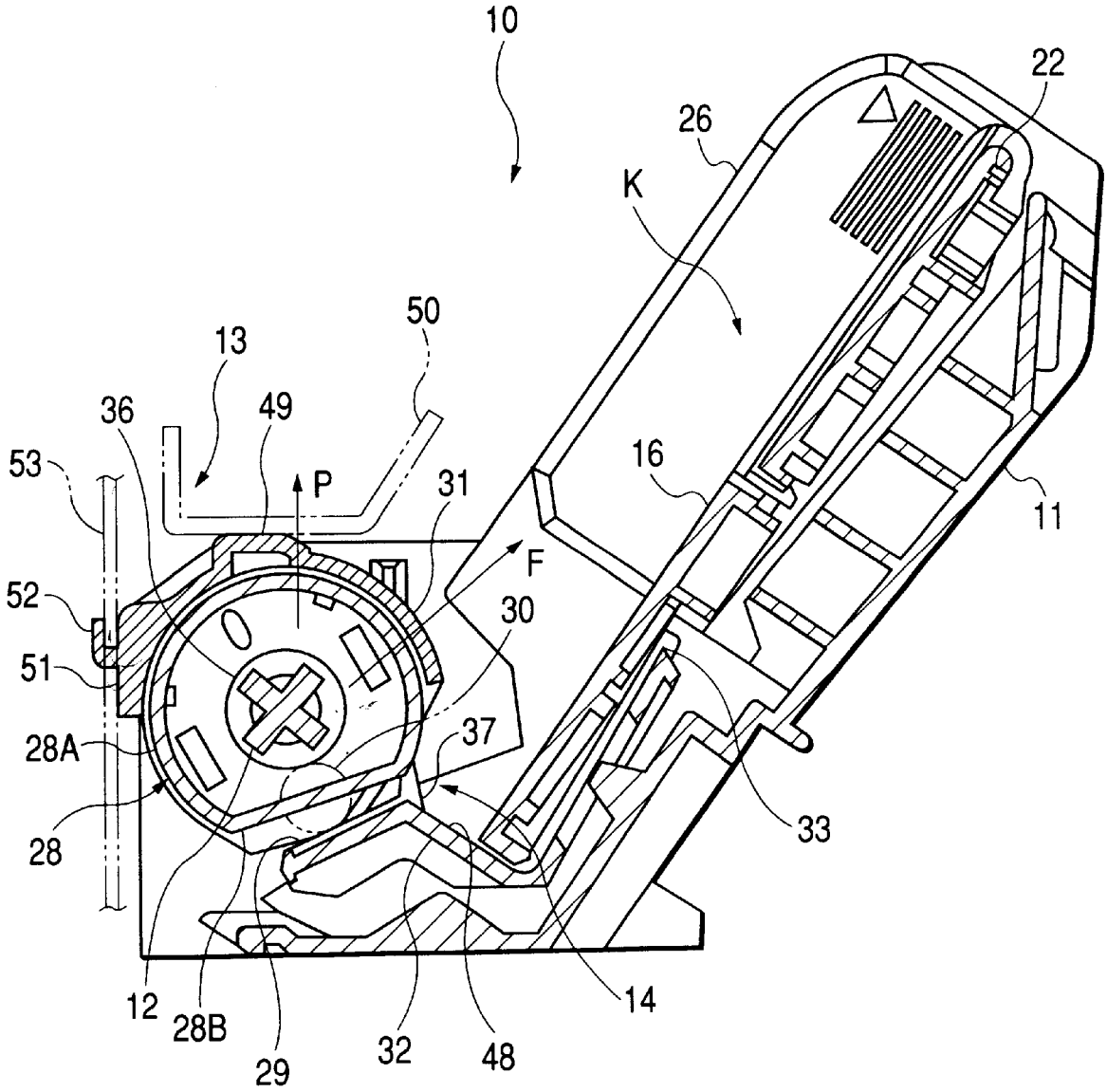
FIG. 3 is a sectional view along a line III—III in FIG. 2.

As described above, in the sheet feeding passage K formed in the apparatus frame 11 for supplying the sheet S from the hopper 16 to the printer 17, the sheet feeding roller unit 13 is disposed at the one end side of the width direction of the sheet S, and only the second sheet returner 15 is disposed at the other side thereof. As shown in FIG. 3, the sheet feeding roller unit 13 is configured to include the sheet feeding roller 28, a separation pad 29, an idle roller 30, a first sheet returner 14 and a roller cover 31.

As shown in FIG. 3, the sheet feeding roller 28 includes an arcuate portion 28A and a flat portion 28B to thereby be formed in a D-character shape when viewed from the side face thereof. High-friction material (for example, rubber) is attached at least to the face of the arcuate portion 28A. The sheet feeding roller 28 is integrally formed by a bush 36, and the bush 36 is integrally fixed to the roller shaft 12 so as to be immovable in the axial direction (that is, the width direction of the sheet S).

A not-shown gear is fixed to the one end portion of the roller shaft 12. The roller shaft 12 is provided so as to be driven and rotatable in the forward and reverse directions by a driving member (not shown) through the gear. When the roller shaft 12 rotates by one revolution in the forward direction, the sheet feeding roller 28 contacts to the uppermost sheet S on the hopper 16 shown in FIG. 5 and rotates by one revolution (forward direction) thereby to make this sheet S possible to be supplied to the transferring roller pair 19 of the printer 17.

The separation pad 29 is fixed to the separation pad holder 32. The separation pad 29 is formed by a material (for example, cork material etc.) having a friction coefficient with respect to the sheet S which is smaller than that of the sheet feeding roller 28. Each of the sheet feeding roller 28 and the separation pad 29 is formed by material which friction coefficient is larger than that between the sheets S. That is, supposing that the friction coefficient between the sheet feeding roller 28 and the sheet S is $\mu 1$, the friction coefficient between the separation pad 29 and the sheet S is $\mu 2$, and the friction coefficient between the sheets S is $\mu 3$, these friction coefficients has a relation of $\mu 1 > \mu 2 > \mu 3$.

As shown in FIGS. 3 and 5, the separation pad holder 32 is rotatably provided at the apparatus frame 11 through a shaft 33. A pad spring 34 is disposed between the leading end portion of the separation pad holder 32 and the apparatus frame 11. The separation pad holder 32 makes the separation pad 29 possible to contact with pressure to the sheet feeding roller 28 by means of the urging force of the pad spring 34.

Thus, the separation pad 29 sandwiches with pressure the uppermost sheet S on the hopper 16 between this separation pad and the sheet feeding roller 28, whereby the uppermost sheet S can be separated from the next-positioned sheet S on the hopper 16 due to the aforesaid difference of the friction coefficients among $\mu 1$, $\mu 2$ and $\mu 3$.

As shown in FIGS. 1 and 3, the idle roller 30 is pivotally supported by an idle roller holder 35. The idle roller holder 35 is formed in a ring-shape for passing the roller shaft 12 therethrough and disposed at the inside of the roller cover 31. The idle roller holder 35 is biased by a not-shown roller spring disposed also at the roller cover 31 to thereby make the idle roller 30 possible to abut against the separation pad 29.

Further, the idle roller holder 35 makes the idle roller 30 possible to contact to and separate from the separation pad 29 in accordance with the rotation of the roller shaft 12 due to the function of a not-shown cam. In other words, the uppermost sheet S on the hopper 16 is started to be supplied due to the rotation (forward rotation) of the sheet feeding roller 28 caused by the rotation of the roller shaft 12, and the idle roller 30 is separated from the separation pad 29 just before the leading end of this sheet S passes between the idle roller 30 and the separation pad 29. Further, the sheet S is continuously supplied while being sandwiched with pressure between the arcuate portion 28A of the sheet feeding roller 28 and the separation pad 29, and the idle roller 30 abuts against the separation pad 29 just before this sandwiching state is released.

In the aforesaid supplying process of the uppermost sheet S, when the sheet S is sandwiched with pressure between the arcuate portion 28A of the sheet feeding roller 28 and the separation pad 29, the next-positioned sheet S on the hopper 16 is prevented from falling by the sandwiched portion. After the sandwiching state of the uppermost sheet S between the arcuate portion 28A of the sheet feeding roller 28 and the separation pad 29 is released, the idle roller 30 abuts against the separation pad 29 through the uppermost sheet S, and the next-positioned sheet S on the hopper 16 is prevented from falling by the abutment portion.

As shown in FIGS. 2 and 3, the first sheet returner 14 of the sheet feeding roller unit 13 is configured to have a lever cam 38 integrally formed with the bush 36 of the sheet feeding roller unit 13 and a sheet reversing lever 37 pivotally supported by the apparatus frame 11. Since the bush 36 is fixed to the roller shaft 12 so as to rotate integrally therewith and is immovable in the axial direction, the sheet feeding roller unit 13 including the first sheet returner 14 is disposed so as to be immovable in the width direction of the sheet S in the sheet feeding passage K.

Figure 4:
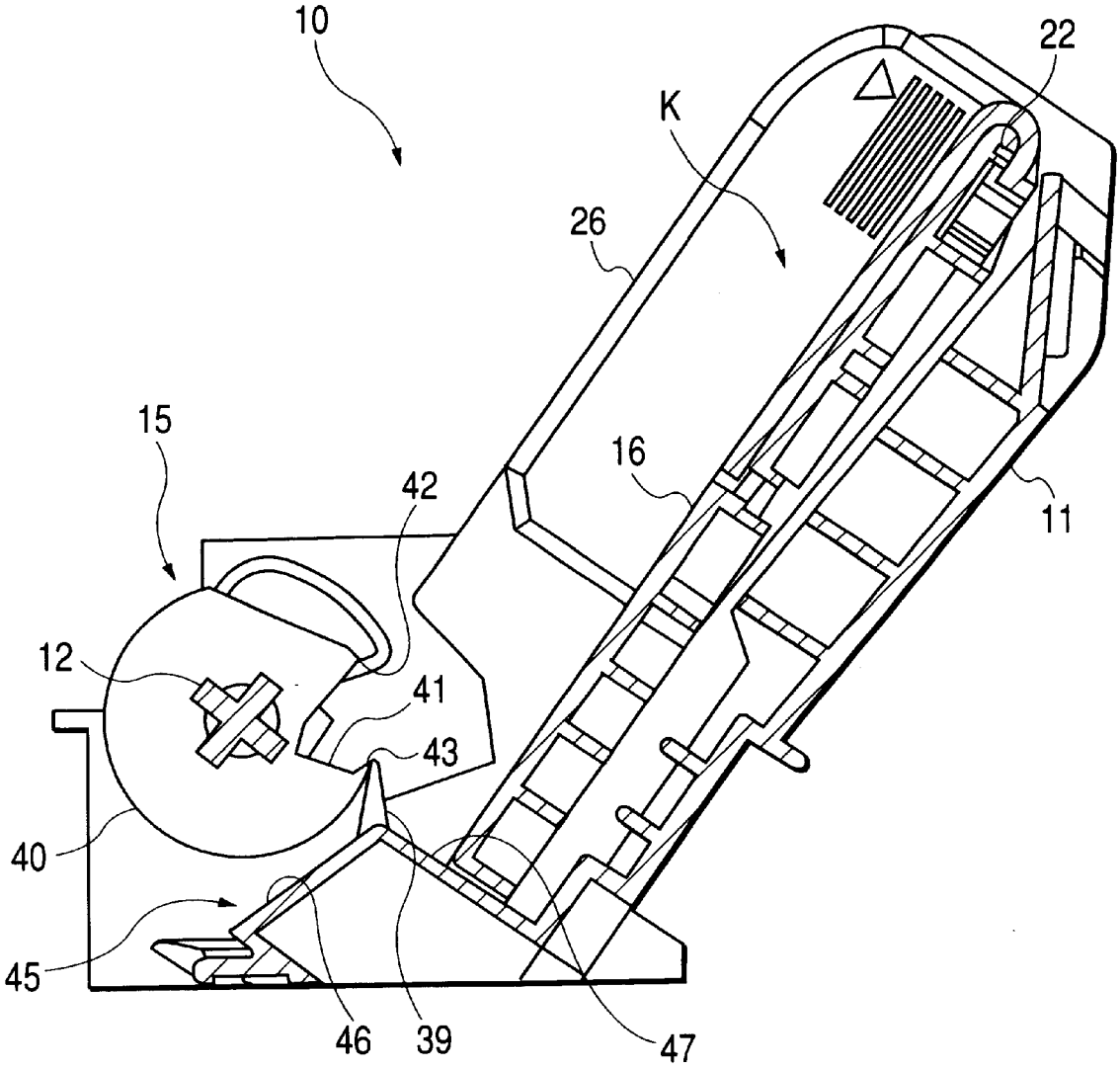
FIG. 4 is a sectional view along a line IV—IV in FIG. 2.

As shown in FIG. 4, the second sheet returner 15 is configured to have a lever cam 40 integrally formed with the roller shaft 12 and a sheet reversing lever 39 pivotally supported by the apparatus frame 11. Thus, the second sheet returner 15 is disposed so as to be immovable in the width direction of the sheet S in the sheet feeding passage K formed in the apparatus frame 11.

The sheet reversing lever 37 of the first sheet returner 14 and the sheet reversing lever 39 of the second sheet returner 15 can be held at neutral positions by not-shown lever springs, respectively. That is, although these sheet reversing levers 37 and 39 are respectively positioned at the neutral positions when no external force (external force due to the lever cams 38, 40 or the sheet S while being supplied) acts thereon, these sheet reversing levers rotate clockwise or counterclockwise in FIGS. 3 and 4 against the urging force of the lever spring when the external force acts thereon. When the external force disappears, these sheet reversing levers restore the neutral positions due to the urging force of the lever springs, respectively.

The lever cam 38 of the first sheet returner 14 and the lever cam 40 of the second sheet returner 15 have the same configuration and each of which is provided with a recess portion 41 at a portion in the circumferential direction of the disk as shown in FIG. 4. The lever cams 38, 40 are arranged in a manner that the sheet reversing levers 37, 39 disposed at the neutral positions come into the recess portions 41 thereof, respectively.

Thus, when the roller shaft 12 rotates forwardly, the lever cams 38 and 40 also rotate forwardly, so that the corner portions 42 of these lever cams 38, 40 abut against the sheet reversing levers 37, 39 thereby to rotate these sheet reversing levers 37, 39 counterclockwise in FIGS. 3 and 4, respectively.

In contrast, when the roller shaft 12 rotates backwardly, the lever cams 38 and 40 also rotate backwardly, so that the corner portions 43 of these lever cams 38, 40 abut against the sheet reversing levers 37, 39 thereby to rotate these sheet reversing levers 37, 39 clockwise in FIGS. 3 and 4, respectively. The separation pad 29 of the sheet feeding roller unit 13 is configured to separate from the idle roller 30 when the sheet reversing levers 37, 39 rotate clockwise.

The clockwise rotation of the sheet reversing levers 37, 39 is performed at a predetermined timing (for example, once each time the uppermost sheet S is supplied or once each time uppermost seven sheets S are supplied) after the uppermost sheet S on the hopper 16 is supplied to the printer 17 side due to the action of the arcuate portion 28A of the sheet feeding roller 28 and the separation pad 29 in the sheet feeding roller unit 13 and the rear end of the uppermost sheet S passes the nipping portion between the idle roller 30 and the separation pad 29. Due to the clockwise rotation of the sheet reversing levers 37, 39, the next-positioned sheet S on the hopper 16 which leading end is positioned on the separation pad 29 can be pushed back to the hopper 16.

Thus, when the roller shaft 12 is rotated forwardly after the aforesaid push-back operation of the sheet S is performed by the first sheet returner 14 and the second sheet returner 15, the next uppermost sheet S on the hopper 16 is supplied one by one to the printer 17 side without being supplied in a duplicated (overlapped) manner.

As shown in FIG. 2, in a case where the sheets S are set in the stacked state on the hopper 16, then the sheet S is disposed in the sheet feeding passage K formed in the apparatus frame 11 and the one side edge Sa of this sheet S is positioned at the side wall 27 of the apparatus frame 11, the sheet feeding roller unit 13 is disposed at the side of the other side edge Sb side of this sheet S when the sheet S has almost A6 size, and the second sheet returner 15 is disposed at the side of the other side edge Sb side of this sheet S when the sheet S has a size in a range larger than almost A6 and to almost B5. In this embodiment, the second sheet returner 15 is disposed at the side of the other side edge Sb side of this sheet S when the sheet S has almost B5 size.

The reasons why the sheet feeding roller unit 13 and the second sheet returner 15 are disposed in the aforesaid manner are as follows. That is, the first reason is to supply the uppermost sheet S on the hopper 16 to the printer 17 side in a good state without being skewed only by the sheet feeding roller unit 13. The second reason is that although the sheet S equal to or smaller than A5 size can be returned to the hopper 16 in a good state without being skewed only by the first sheet returner 14 of the sheet feeding roller unit 13, the sheet S equal to or larger than A5 size can not be returned to the hopper 16 without being skewed without using both the first sheet returner 14 of the sheet feeding roller unit 13 and the second sheet returner 15.

Thus, the sheet S smaller than the disposed position of the second sheet returner 15, for example, the sheet S having the size of A5, A6 or smaller can be returned to the hopper 16 in a good state without being skewed only by the first sheet returner 14 of the sheet feeding roller unit 13. In contrast, the sheet S equal to or larger than the disposed position of the second sheet returner 15, for example, the sheet S having the size of B5 or A4 can be returned to the hopper 16 in a good state without being skewed by both the first sheet returner 14 of the sheet feeding roller unit 13 and the second sheet returner 15.

Further, in the apparatus frame 11 of the embodiment, the guide members 44, 45 constituting a part of the sheet feeding passage K for guiding the sheet S are formed in the vicinities of the first sheet returner 14 of the sheet feeding roller unit 13 and the second sheet returner 15. Each of these guide members 44, 45 has a guide face 46 and a back face 47 as shown in FIGS. 2 and 4.

The faces 46 of the guide members 44, 45 guide both the sheet S supplied to the printer 17 side by the sheet feeding roller 28 of the sheet feeding roller unit 13 and the sheet S returned to the hopper 16 by the first sheet returner 14 of the sheet feeding roller unit 13 and the second sheet returner 15. The slanted angle of the guide face 46 is set to such an angle that the sheet S on the guide face 46 does not fall by its own weight. As described above, the back faces 47 of the guide members 44, 45 abut against the leading end of the sheets S stacked on the hopper 16 together with the back face 48 (FIG. 3) of the separation pad holder 32 of the sheet feeding roller unit 13 to thereby align the leading ends of the sheets.

The reason why the guide members 44, 45 are not continuously formed in the width direction of the sheet S in the sheet feeding passage K but formed separately in the vicinities of the first sheet returner 14 and the second sheet returner 15, respectively, as shown in FIG. 2, is as follows.

That is, in the case where the guide members 44, 45 are continuously formed in the width direction of the sheet S in the sheet feeding passage K, if the sheet S is skewed or warped, at the time of the push-back operation of the sheet S by the first sheet returner 14 and the second sheet returner 15, such a sheet S can not be returned surely on the hopper 16 by the first sheet returner 14 and the second sheet returner 15. In the case where the guide members 44, 45 are disposed separately in the vicinities of the first sheet returner 14 and the second sheet returner 15, respectively, even if the sheet S is skewed or warped, such a sheet S is guided on the faces 46 of the guide members 44, 45 by the push-back operation of the first sheet returner 14 and the second sheet returner 15 and so surely returned to the hopper 16.

As shown in FIGS. 1 to 3 (particularly FIG. 3), the roller cover 31 is provided as a part of the sheet feeding roller unit 13 so as to cover the sheet feeding roller 28, the lever cam 38, the idle roller holder 35 and the idle roller 30. The top panel portion 49 of the roller cover 31 abuts against and is supported by a frame 50 bridged horizontally in the printer 17. When the sheet feeding roller 28 of the sheet feeding roller unit 13 is made in contact with pressure to the separation pad 29 through the sheet S, an upward force P in the height direction of the printer 17 acting on the sheet feeding roller 28 from the separation pad 29 (the separation pad holder 32) is received by the frame 50.

Further, a hook-shaped engagement claw 52, which protrudes in the forward direction of the printer 17 and is bent perpendicularly upward in the height direction of the printer 17, is integrally provided with the front face portion 51 of the roller cover 31. This engagement claw 52 is arranged to be engaged with or stopped by a main frame 53 extending to the scanning direction of the recording head 20 in the printer 17. In the state where the engagement claw 52 is stopped by the main frame 53, when the sheet feeding roller 28 of the sheet feeding roller unit 13 is made in contact with pressure to the separation pad 29 through the sheet S, a force F acting on the sheet feeding roller 28 from the separation pad 29 (the separation pad holder 32) in a direction shown by an arrow in FIG. 3 (toward the back face 48 of the separation pad holder 32) is received by the main frame 53, so that the roller cover 31 is prevented from being rotated together with the roller shaft 12.

Since the force F is received by the main frame 53 through the engagement claw 52, the pressure contact state between the arcuate portion 28A of the sheet feeding roller 28 and the separation pad 29 is secured in a good state and the uppermost sheet S on the hopper 16 can be separated well from the next-positioned sheet S. Further, since the co-rotation of the roller cover 31 can be prevented, the idle roller 30 of the sheet feeding roller unit 13 is held at a suitable position with respect to the separation pad 29. Thus, the abutment state between the idle roller 30 and the separation pad 29 becomes well, and the next-positioned sheet S on the hopper 16 is prevented from falling into the nipping portion between the idle roller 30 and the separation pad 29.

Advantageous effect which is able to be attained by the present invention will be summarized as follows.

i) The sheet feeding roller unit 13 having the sheet feeding roller 28, the separation pad 29, the separation pad holder 32, the idle roller 30, the idle roller holder 35 and the first sheet returner 14 is disposed on the one end (the side wall 27) side in the width direction of the sheet S in the sheet feeding passage K of the apparatus frame 11, and only the second sheet returner 15 is disposed on the other side thereof. Thus, the next-positioned sheet S on the hopper 16 which leading end is positioned on the separation pad 29 can be completely returned to the hopper 16 without being skewed by the first sheet returner 14 and the second sheet returner 15. Therefore, in accordance with the forward rotation of the sheet feeding roller 28 which is operated next, the uppermost sheet S (that is, the aforesaid next-positioned sheet S) can be supplied well without being supplied in a duplicated manner from the hopper 16 to the printer 17.

ii) The sheet feeding roller unit 13 is disposed only at the one end (the side wall 27) side of the sheet feeding passage K of the apparatus frame 11 and only the second sheet returner 15 in place of the sheet feeding roller unit 13 is disposed at the other end side thereof. Thus, the number of parts of the sheet feeder 10 can be reduced, so that the benefits can be realized.

iii) The sheet feeding roller unit 13 and the second sheet returner 15 are disposed so as to be immovable in the width direction of the sheet S in the sheet feeding passage K of the apparatus frame 11. Thus, since none of the sheet feeding roller unit 13 or the second sheet returner 15 moves in the width direction of the sheet S in cooperation with the edge guide 26 of the hopper 16, the resistance (sliding load) caused at the time of sliding the edge guide 26 can be reduced and so the sliding operation of the edge guide 26 can be performed smoothly.

iv) The guide members 44, 45 constituting the part of the sheet feeding passage K in the apparatus frame 11 for guiding the sheet S are separately formed in the vicinities of the first sheet returner 14 and the second sheet returner 15, respectively. Thus, as compared with the case where the guide members 44, 45 are formed continuously in the width direction of the sheet S, even if the next-positioned sheet S on the hopper 16 which leading end is positioned at the separation pad 29 is skewed or warped, the sheet is guided by the guide members 44, 45 by the operation of the first sheet returner 14 and the second sheet returner 15 and so the next-positioned sheet S can be surely returned to the hopper 16. Therefore, in accordance with the forward rotation of the sheet feeding roller 28 of the sheet feeding roller unit 13 which is operated next, only the uppermost sheet S (that is, the aforesaid next-positioned sheet S) on the hopper 16 can be supplied to the printer 17 and the sheets S can be prevented from being supplied in a duplicated manner.

v) The second sheet returner 15 is disposed so as to be positioned on the other side edge Sb side of the sheet S having the size in a range larger than almost A6 and to almost B5 in the case where the sheet S is disposed in the sheet feeding passage K of the apparatus frame 11 and the one side edge Sa of this sheet S is positioned at the one end (the side wall 27) of the sheet feeding passage K. Thus, the sheet S having the size equal to or smaller than almost A6 is returned to the hopper 16 only by the first sheet returner 14 of the sheet feeding roller unit 13, the sheet S having the size in a range larger than almost A6 and to B5 is returned to the hopper 16 only by the first sheet returner 14 or by both the first sheet returner 14 and the second sheet returner 15, and the sheet S having the size larger than almost B5 is returned to the hopper 16 by both the first sheet returner 14 and the second sheet returner 15. In this manner, any sizes of the sheet S can be returned to the hopper 16 by properly using the first sheet returner 14 and the second sheet returner 15 without being skewed.

vi) Since the lever cam 40 of the second sheet returner 15 is integrally formed with the roller shaft 12 supporting the sheet feeding roller 28, the accuracy of the parts of the lever cam 40 can be improved and the number of the parts thereof can be reduced.

vii) At the time of supplying the sheet S by the sheet feeding roller 28 of the sheet feeding roller unit 13, the roller cover 31 of the sheet feeding roller unit 13 is secured by the main frame 53 of the printer 17 through the engagement claw 52 so as to receive the force F acting on the sheet feeding roller 28 from the separation pad 29 while being directed toward the back face of the separation pad 29 (that is, the separation pad holder 32). Thus, the sheet feeding roller unit 13 can be prevented from moving toward the back face 48 of the separation pad holder 32 by the force F. As a result, the pressure contacting state between the sheet feeding roller 28 and the separation pad 29 is secured well and the sheet S can be supplied well to the printer 17 from the hopper 16.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

For example, although the embodiment is described as to the case where the sheet is supplied to the printer 17, the sheet may be supplied to another image forming apparatus such as a copy machine, a facsimile etc.

What is claimed is:

1. A sheet feeder for feeding sheets of a recording medium to a recording apparatus, comprising:

a hopper, on which the sheets of recording medium are stacked;

a sheet feeding roller, which is brought into contact with an uppermost sheet stacked on the hopper, and rotates to feed the uppermost sheet to the recording apparatus;

a separation pad, which presses the uppermost sheet against the feeding roller so that the upper most sheet is separated from a next uppermost sheet;

a first sheet returner, which pushes back a first part of the next uppermost sheet situated on the separation pad to the hopper; and a second sheet returner, which pushes back a second part of the next uppermost sheet situated on the separation pad to the hopper, wherein the sheet feeding roller, the separation pad and the first sheet returner are incorporated in a single unit which is disposed at a first position of a sheet feeding passage formed on the hopper, and the second sheet returner is solely disposed at a second position of the sheet feeding passage.

2. The sheet feeder as set forth in claim 1, wherein the first sheet returner and the second sheet returner are provided immovably in a widthwise direction of the sheet feeding passage.

3. The sheet feeder as set forth in claim 1, further comprising guide members which are separately provided in the vicinity of the first sheet returner and the second sheet returner, each of the guide members having a guide face which forms a part of the sheet feeding passage.

4. The sheet feeder as set forth in claim 1, wherein the hopper includes an edge guide member, on which one side edges of the stacked sheets are aligned;

wherein the first position of the sheet passage is in the vicinity of the edge guide member; and wherein a distance between the edge guide member and the second position almost corresponds to a width of a sheet having a size in a range from A6 to B5.

5. The sheet feeder as set forth in claim 1, the second sheet returner includes a sheet returning lever, and a lever cam, which is integrally provided with a rotary shaft of the sheet feeding roller, for operating the sheet returning lever.

6. The sheet feeder as set forth in claim 1, wherein the single unit incorporating the sheet feeding roller, the separation pad and the first sheet returner is secured to the recording apparatus such that a force acting from the separation pad to the sheet feeding roller when the uppermost sheet is fed is received by the recording apparatus.

7. The sheet feeder as set forth in claim 6, wherein the single unit is formed with a hook member engaged with a part of the recording apparatus so that the force is received by the recording apparatus through the hook member.

8. A sheet feeder for feeding sheets of a recording medium to a recording apparatus, comprising:

a hopper, on which the sheets of recording medium are stacked;

a sheet feeding roller, which is brought into contact with an uppermost sheet stacked on the hopper, and rotates to feed the uppermost sheet to the recording apparatus;

a separation pad, which presses the uppermost sheet against the sheet feeding roller so that the upper most sheet is separated from a next uppermost sheet; and a cover member, which covers the sheet feeding roller and which comprises a top portion which abuts against and is supported by the recording apparatus, wherein a force acting from the separation pad to the sheet feeding roller when the uppermost sheet is fed, is received by the recording apparatus.

9. The sheet feeder as set forth in claim 8, wherein the cover member is formed with a hook member engaged with a part of the recording apparatus so that the force is received by the recording apparatus through the hook member.

* * * * *